US008439164B1

(12) United States Patent
Esposito

(10) Patent No.: US 8,439,164 B1
(45) Date of Patent: May 14, 2013

(54) HEAVY DUTY, KNOCK-DOWN SAWHORSE WITH LEVELING CAPABILITY

(76) Inventor: Peter Esposito, Calgary (CA)

( * ) Notice: Subject to any disclaimer, the term of this patent is extended or adjusted under 35 U.S.C. 154(b) by 0 days.

(21) Appl. No.: 13/344,203

(22) Filed: Jan. 5, 2012

(51) Int. Cl.
*E04G 1/32* (2006.01)

(52) U.S. Cl.
USPC ..... 182/153; 182/186.5; 182/182.1; 182/225

(58) Field of Classification Search ..... 182/153, 182/181.1, 186.4, 186.5, 182.1, 182.4, 224, 182/225; D25/67; 52/745.1; 116/63 P; 256/64, 256/66; 403/376
See application file for complete search history.

(56) References Cited

U.S. PATENT DOCUMENTS 592,574 A * 10/1897 Ring ..... 182/186.3
1,462,707 A * 7/1923 Lawlor ..... 182/186.4
1,819,252 A * 8/1931 Linsner ..... 182/153
2,721,060 A * 10/1955 Morain ..... 256/64
3,036,657 A * 5/1962 Ladue ..... 182/224
4,325,463 A * 4/1982 Taylor ..... 182/155
4,496,028 A * 1/1985 Peterson ..... 182/186.5
4,711,319 A * 12/1987 Sansotta et al. ..... 182/155

* cited by examiner

*Primary Examiner* — James O Hansen
*Assistant Examiner* — Kristine Florio
(74) *Attorney, Agent, or Firm* — Sean W Goodwin

(57) ABSTRACT

A knock-down sawhorse has a support beam supported above a surface by at least two pairs of legs, each pair of legs supporting opposing ends of the beam. The beam has at least four connectors, at least a first pair of connectors arranged on opposing lateral side walls at one end and at least a second pair of connectors arranged on opposing lateral side walls at the other opposing end. Each connector has a tab downwardly depending from a top wall of the beam for engaging an axially-extending recess in an upper end of each leg. Each pair of legs is interconnected by an adjuster for adjusting a lateral spacing therebetween. Manipulation of the lateral spacing between each pair of legs allows a working height of the sawhorse to be manipulated, allowing the sawhorse to be leveled.

5 Claims, 8 Drawing Sheets

HEAVY DUTY, KNOCK-DOWN SAWHORSE WITH LEVELING CAPABILITY

FIELD OF THE INVENTION

Embodiments of the present invention relate to sawhorses, more particularly to heavy duty, knock-down sawhorses having removable legs and leveling capabilities.

BACKGROUND OF THE INVENTION

Sawhorses of one type or another have been used by carpenters and others for many centuries and most everyone is aware of the typical sawhorse having a horizontal beam supported at opposing ends by a pair of legs. As one skilled in the art would understand, the dimensions of the sawhorse can be altered to suit particular needs.

The need for a sawhorse is often a temporary one, and between uses it is convenient to knock-down the sawhorse to a more compact and portable form. A knock-downed form allows the sawhorse to be transported more easily to where it is needed so that it can be re-assembled for use. Typically, assembly and disassembly of knock-down sawhorses involved clamps, bolts, screws and nails.

U.S. Pat. No. 4,014,405 to Breisch discloses a knock-down sawhorse which can be assembled without the use of bolts, screws, nails, or clamps. Breisch teaches two pairs of identical legs that each cooperatively fit within a recess along a bottom of a horizontal beam. The horizontal beam is supported at each end by a pair of the identical legs. The cooperating legs securely fit within the recess without the use of bolts, screws, nails or clamps. Breisch's sawhorse is composed of thermoplastic and its legs are not adjustable for leveling the horizontal beam.

U.S. Pat. No. 5,305,850 to McQuiston teaches a horizontal beam having grooves at opposing ends for receiving a corresponding pair of legs. McQuiston's knock-down sawhorse obviates the need for bolts, screws, nails or clamps for assembly of the sawhorse. Similar to Breisch, McQuiston's legs are not adjustable for leveling the horizontal beam.

Very popular in recent times have been the folding or collapsible type sawhorses. As disclosed in U.S. Pat. No. 4,296,834 to Kroger, a folding sawhorse typically has a horizontal beam supported by a pair of legs at each opposing end of the horizontal beam. The two pairs of legs are each pivotally connected to the horizontal beam to allow the pair of legs to pivot longitudinally towards the horizontal beam, thereby collapsing the sawhorse for storage or transportation. Collapsible sawhorses obviate the need to disassemble and reassemble a sawhorse when storing, transporting or using it.

U.S. Pat. No. 4,804,064 to Coultrup et al. teaches a lightweight collapsible sawhorse that is vertically adjustable. Each of the four legs used in Coultrup's sawhorse is telescopically adjustable in length, allowing a user to adjust a working height of the sawhorse at each end for leveling the sawhorse. Coultrup's telescopic legs can be locked into or released from a position by the use of spring tabs which permits a user to level the sawhorse on uneven working surfaces. As a result, a maximum load bearing capacity of Coultrup's sawhorse is diminished and limited, not by the load bearing capacity of the support legs, but by the load bearing capacity of the spring tabs used to lock each leg in a particular position.

U.S. Pat. No. 5,908,182 to Stang et. al. discloses an adjustable and foldable sawhorse that is also capable of being leveled. Stang's sawhorse comprises a horizontal beam supported at both opposing ends by A-shaped frames and a support frame having two vertical posts interconnecting the two A-shaped frames. Each A-shaped frame is movably supported on the vertical post of the support frame and can be independently adjusted in height to level the sawhorse on uneven working surfaces. Similar to Coultrup's sawhorse, the load bearing capacity of Stang's sawhorse is diminished and limited, not by the load bearing capacity of the support legs, but rather by the load bearing capacity of the support frame.

There is a need for a heavy duty commercial sawhorse that is easily stored, adjustable and is capable of being leveled while maintaining its maximum load bearing capacity.

SUMMARY OF THE INVENTION

Embodiments of a heavy duty, knock-down sawhorse can have a beam that is supported at opposing ends by a pair of splayed legs. Each opposing end of the beam has a pair of connectors for removably connecting to a corresponding leg. Each leg fully engages the beam for equally distributing a load between each of the legs supporting the beam.

The legs of each pair of legs are spaced apart from one another by an adjuster for adjusting a lateral spacing therebetween. The adjuster can be manipulated to increase or reduce the lateral spacing between each of the laterally splayed pair of legs, thereby adjusting a working height of the sawhorse. When the adjuster increases the lateral spacing, a working height of the sawhorse is reduced. Similarly, when the adjuster decreases the lateral spacing, the working height of the sawhorse is increased. Adjustment of the lateral spacing between the legs at each end allows a user to level the sawhorse when working on uneven surfaces.

In a broad aspect of the invention a heavy duty, knock-down sawhorse has a beam having a longitudinal extent and lateral sides. At least a first pair of legs support a first end of the beam above the ground, while at least a second pair of legs support a second end of the beam above the ground. Each leg has an upper end having an axially-extending recess formed therein bounded by end walls for engaging at least four connectors arranged along the beam.

At least a first pair of connectors and at least a second pair of connectors are arranged on the opposing lateral sides of the beam, the at least first pair of connectors being longitudinally spaced apart from the at least second pair of connectors. Each connector further comprises a tab extending downwardly from the beam and engages the axially-extending recess of a corresponding leg for supporting the beam above each leg.

Each pair of legs is splayed apart at an angle from the beam for forming the sawhorse.

BRIEF DESCRIPTION OF THE DRAWINGS

FIG. 3C further illustrates a cross-section upper end of a leg oriented for connecting therewith;

DETAILED DESCRIPTION OF THE INVENTION

Figure 1B:
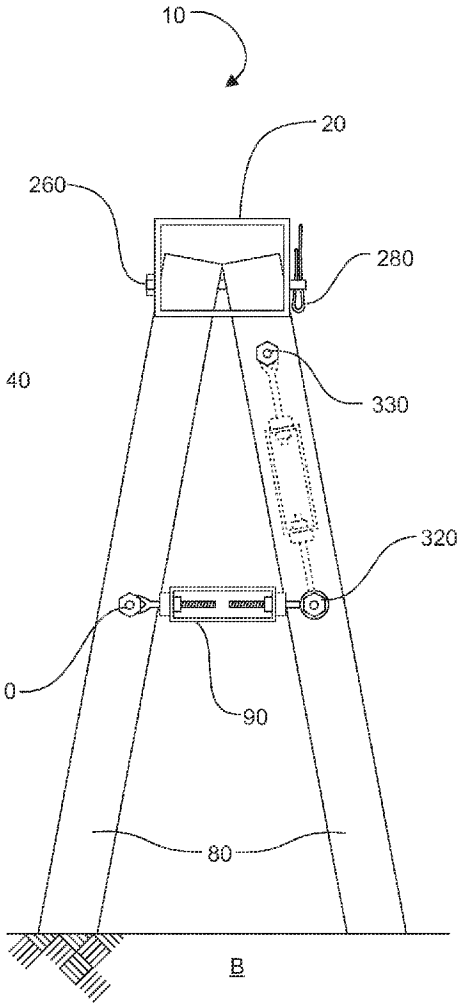
FIG. 1B is an end view of the sawhorse of FIG. 1A illustrating a turnbuckle for adjusting the height of one end of the sawhorse.
Figure 1A:
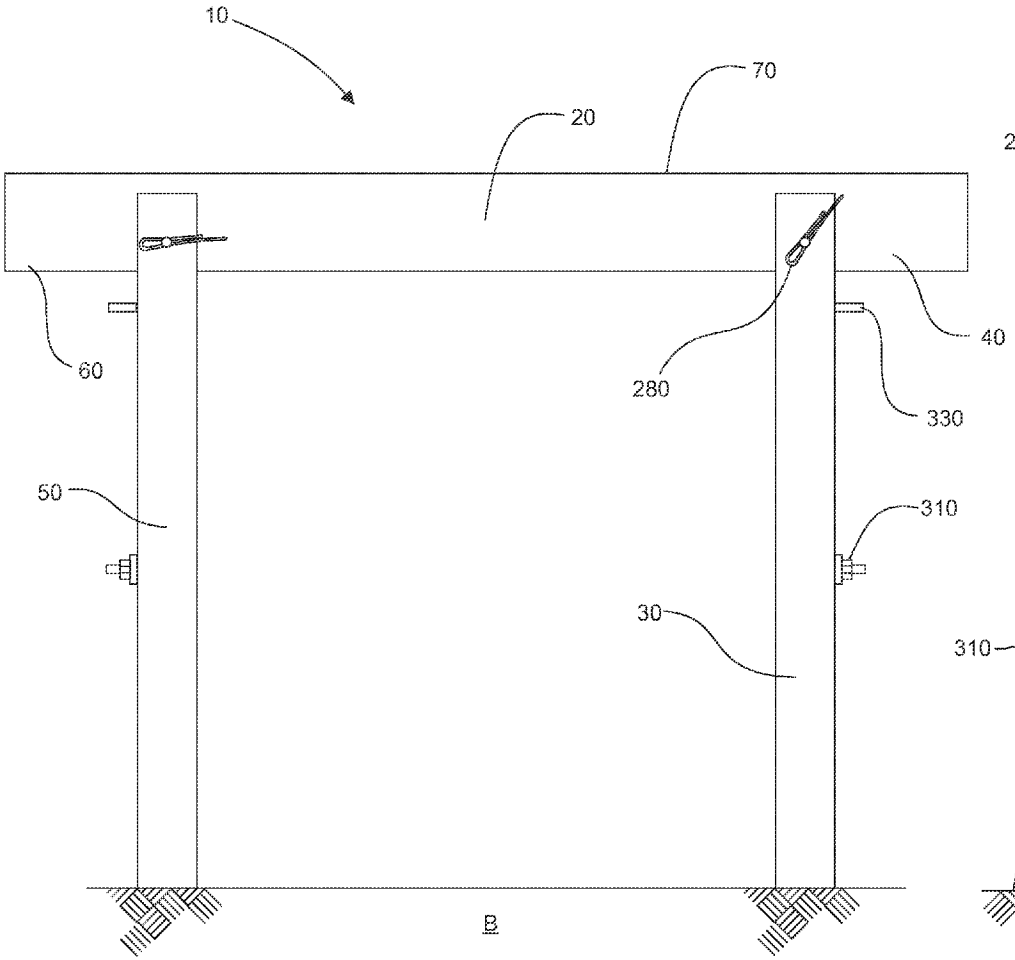
FIG. 1A is side view of an embodiment of the present invention illustrating a heavy duty, knock-down sawhorse having a horizontal beam being supported at both ends by a pair of legs.

With reference to FIGS. 1A and 1B, an embodiment of a heavy duty sawhorse 10 comprises a support beam 20 having a longitudinal extent and lateral sides, which is generally horizontal when oriented for use, supported by a first pair of independent legs 30 adjacent a first end 40 of the support beam 20 and a second pair of independent legs 50 adjacent a second end 60. The support beam 20 has an upper surface 70 adapted to receive a heavy load or workpiece, supported off of a floor, ground or other base B by the first and second pairs of legs 30,50. The first pair of legs 30 extend downwardly to engage the base and are splayed apart laterally in an upside down "V" shape. Similarly, the second pair of legs 50 extend downwardly and are also splayed laterally in an upside down "V" shape. The splayed provide both support and lateral stability. A longitudinal spacing S of the first and second pairs of legs 30,50 provides longitudinal stability. The first and second pairs of legs 30,50 need not be located at the ends of the support beam 20, but merely spaced apart therealong.

Each independent leg 80 is removably and lockably connected to the support beam 20 for permitting easy knock-down of the sawhorse 10 for storage or transportation. Each of the two legs 80,80 of each pair of legs 30,50 are adjustably spaced apart by an adjuster 90 for adjusting a lateral spacing between the two legs.

Figure 2:
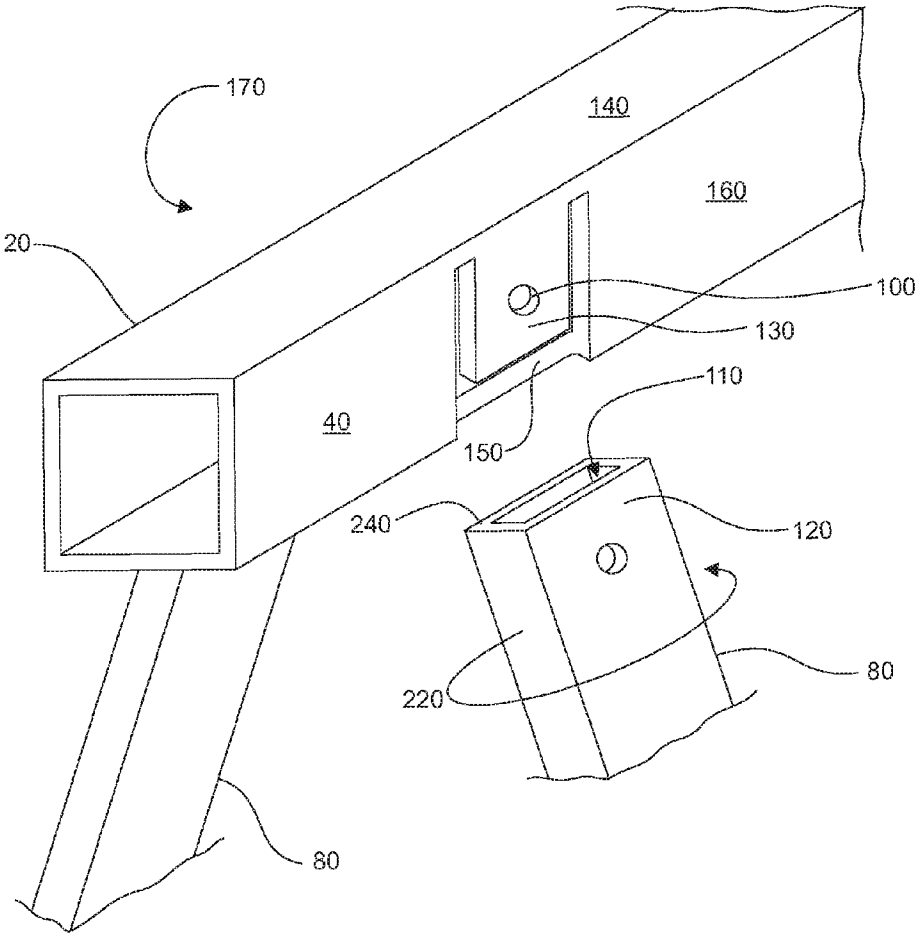
FIG. 2 is a perspective view of one end of an embodiment of the sawhorse illustrating a connector tab depending downwardly from a horizontal beam and a leg poised for connecting with the tab.

With reference to FIG. 2, the support beam 20 has two opposing lateral sides, a right side and a left side. The support beam 20 further comprises at least four connectors arranged along the beam 20. A connector tab 100 is provided for each leg 80, a first pair of tabs 100,100 at the first end 40 for the first pair of legs 30, one tab on the right and one of the left side of the support beam 20. Similarly (although not shown), a second pair of tabs 100,100 is provided at the second end 60 for the second pair of legs 50, one tab on the right and one of the left side of the support beam 20. Each leg 80 has an axially-extending recess 110 at an upper end 120. Each tab 100 projects downwardly from the support beam 20 and has a free end 130 for insertion into the axially-extending recess 110 of its respective leg 80.

In an embodiment, the support beam 20 can be a structural beam having lateral sidewalls and at least a web extending longitudinally therebetween. As shown, the support beam is a rectilinear hollow tubing having four walls about a hollow interior, a top wall 140 forming the web or working upper surface, a bottom web or wall 150 and right and left side walls 160,170. The tabs 100 can be formed from the right and left side walls 160,170.

Figure 3A:
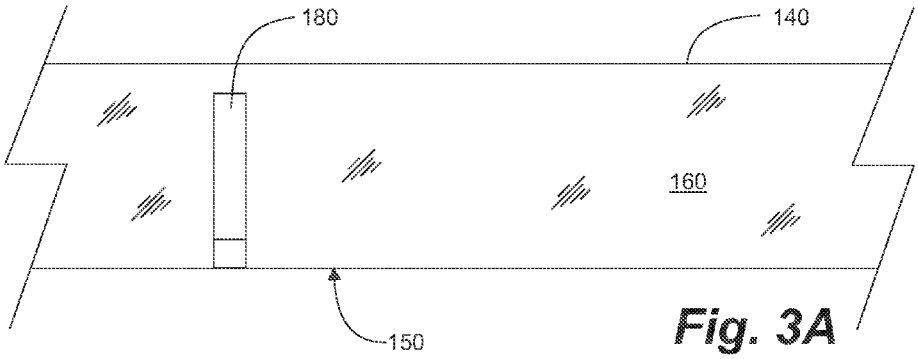
FIGS. 3A through 3C illustrating one embodiment of the step for forming one of a pair of connector tabs, and more particularly: cutting a first vertical slot in a lateral side, cutting of a second vertical slot spaced longitudinally from the first slot, and removing of base material for interconnection of the first and second slots and opening the tab for receiving a tubular leg respectively.
Figure 3B:
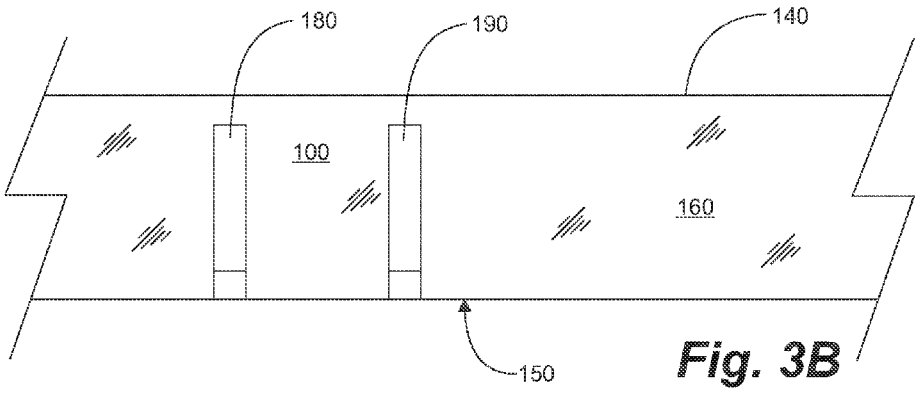
Figure 3C:
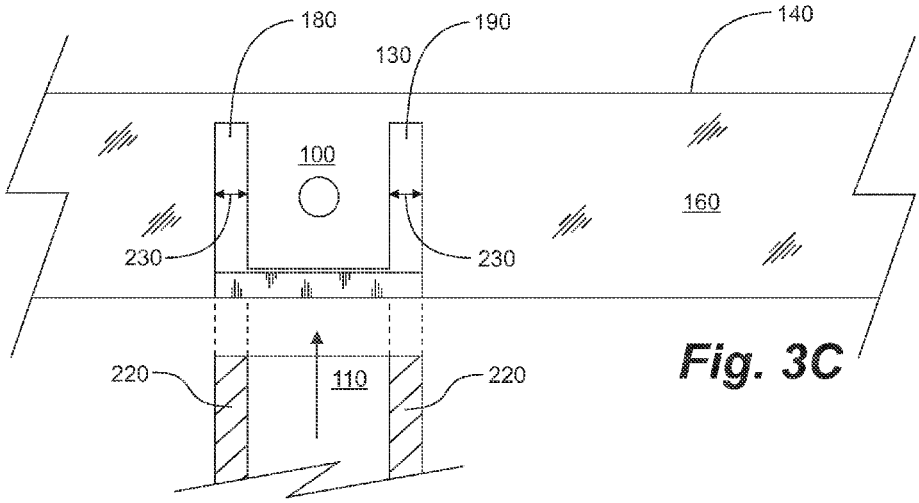

With reference to FIGS. 3A to 3C, one can form the tabs 100 from the hollow tubing. As shown in FIG. 3A, facing a side wall, say the right side wall 160, a first slot 180 can be cut entirely through the right side wall 160 to the hollow interior, commencing adjacent the top wall 140 and terminating adjacent the bottom wall 150. As shown in FIG. 3B, a second slot 190 can be cut entirely through the right side wall 160 to the hollow interior, spaced longitudinally from the first slot 180 and commencing again, adjacent the top wall 140 and terminating adjacent the bottom wall 150. Finally, with reference to FIG. 3C, the first and second slots 180,190 are interconnected to form the free end 130 by removing a portion longitudinally along the bottom wall 150 between the first and second slots 180,190, the tab 100 only remaining connected to the support beam 20 adjacent the top wall 140. A leg brace portion 150F is formed by the remaining bottom wall 150.

Figure 3D:
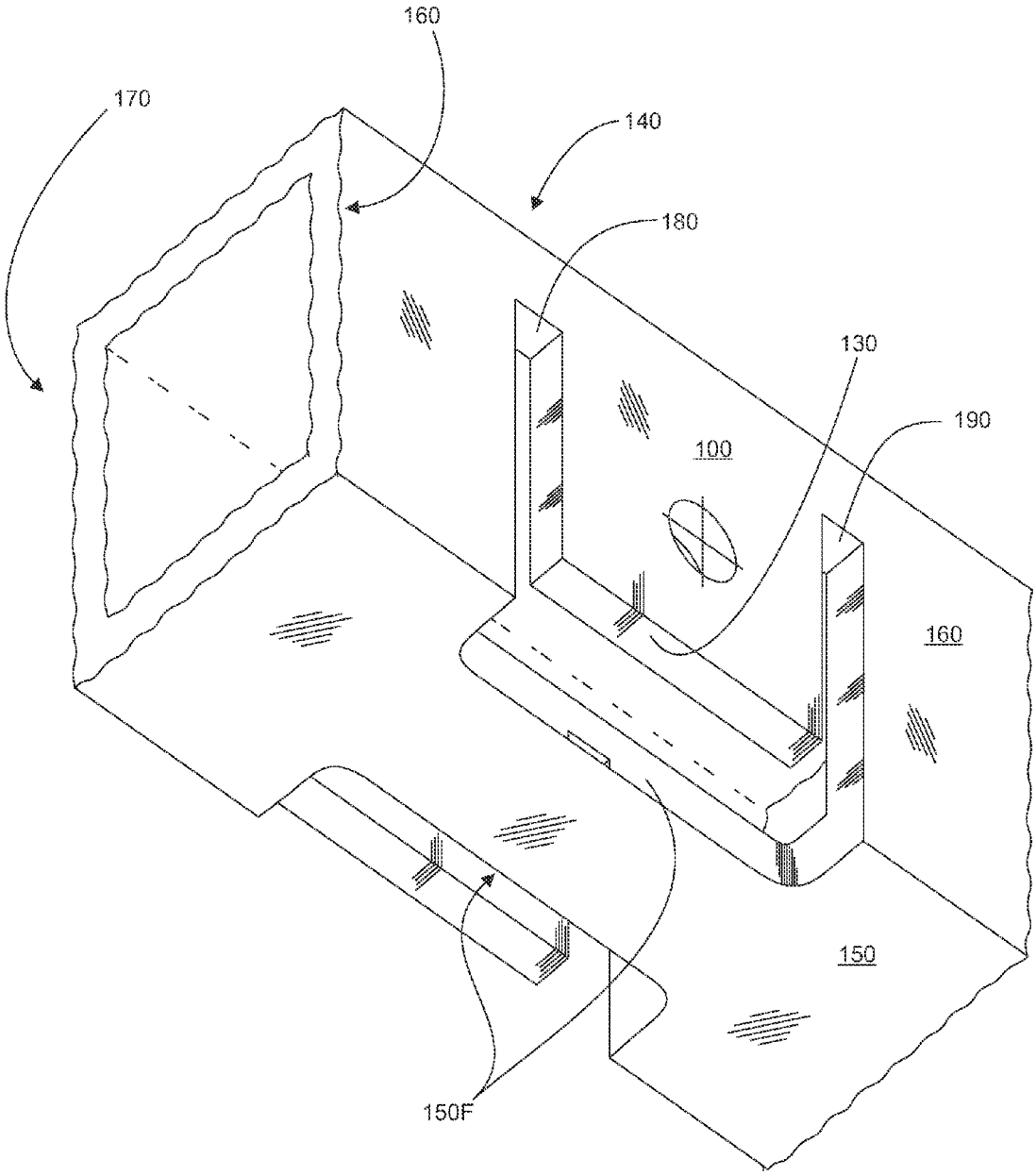
FIG. 3D is a perspective, underside view of a portion of the horizontal beam having the connector tabs.

As shown in FIG. 3D, a tab 100 can be similarly formed on the left side wall 170, generally opposing the first tab for providing a first pair of tabs receiving the first pair of legs 30. Further a second pair of tabs can be provided on the left and rights sides adjacent the second end 60 of the support beam 20 for receiving the second pair of legs 50.

Figure 3F:
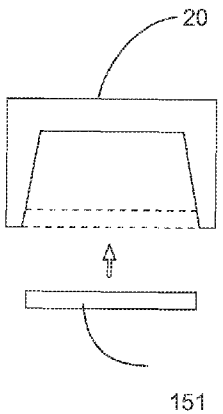
FIG. 3F is an end view of the embodiment of FIG. 3E.
Figure 3E:
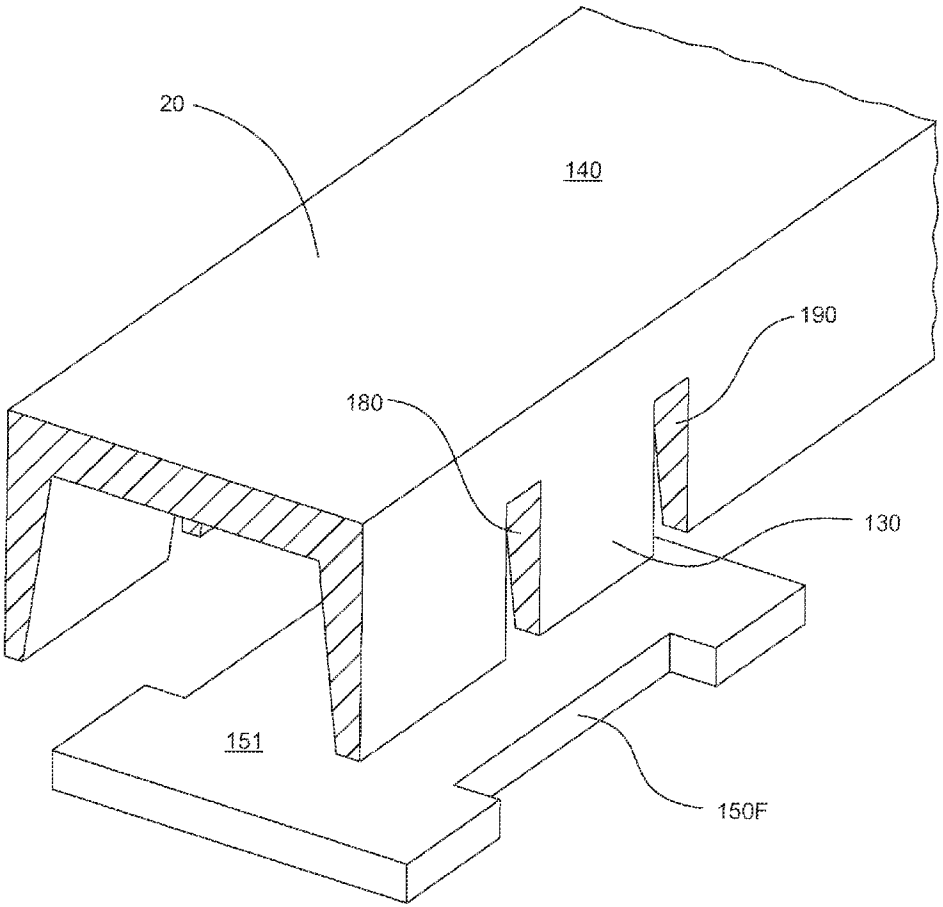
FIG. 3E is a perspective, end view of a portion of a channel-shaped horizontal beam having the connector tabs formed therein and periodic bottom wall inserts.

As shown in FIGS. 3E and 3F, the beam can be a U-shaped channel-shaped cross-section rotated with the lateral sides 160,170 depending downwardly, the top wall 140 forming the web. Absent a contiguous bottom wall like the previous embodiment, a bottom plate 151 is affixed periodically along the longitudinal beam 20 and at each leg location to form a periodic bottom wall and provide a leg brace portion 150F.

As shown in FIGS. 2 and 3C, the upper end 120 of each leg 80 has an axially-extending recess 110, bounded by peripheral walls 220,220. Each leg 80 can also be rectilinear hollow tubing wherein the recess 110 is formed by the hollow interior and extends the length or height of the leg, although all that is required for the recess is peripheral walls at the upper end 120. End peripheral walls 220,220 of the upper end 120 of the each leg 80 are spaced to correspond with the longitudinal spacing between the first and second slots 180,190. Further, the first and second slots 180,190 have a width or kerf 230 sized to accept the wall thickness of the end peripheral walls 220,220. Further, the lateral peripheral walls 240,240 of the upper end 120 of the each leg 80 provide guides for retaining the leg 80 laterally to the tab 100 and controlling longitudinal rotational movement of the engaged leg 80.

The first and second slots 180,190 are parallel so as to receive parallel end peripheral walls 220,220 of leg 80. The upper end 120 of each leg engages an upper extent 250 of the kerfs 230 or the top wall 140 of the support beam 20 or combination thereof. Thus, load on the support beam 20 is directed into the leg 80. As shown in one embodiment, the first and second slots 180,190 are substantially vertical and orient the legs 80 perpendicular to the support beam 20 when viewed from the side. In another embodiment, the parallel first and second slots 180,190 can be angled to further splay the first pair of legs 30 from the second pair of legs 50 at an angle from the beam 20.

The width of the kerf 230 is sized about the same as a width of the end peripheral walls 220 for minimizing angular movement therebetween and minimizing longitudinal movement of the sawhorse 10 for increasing the stability thereof.

Figure 4:
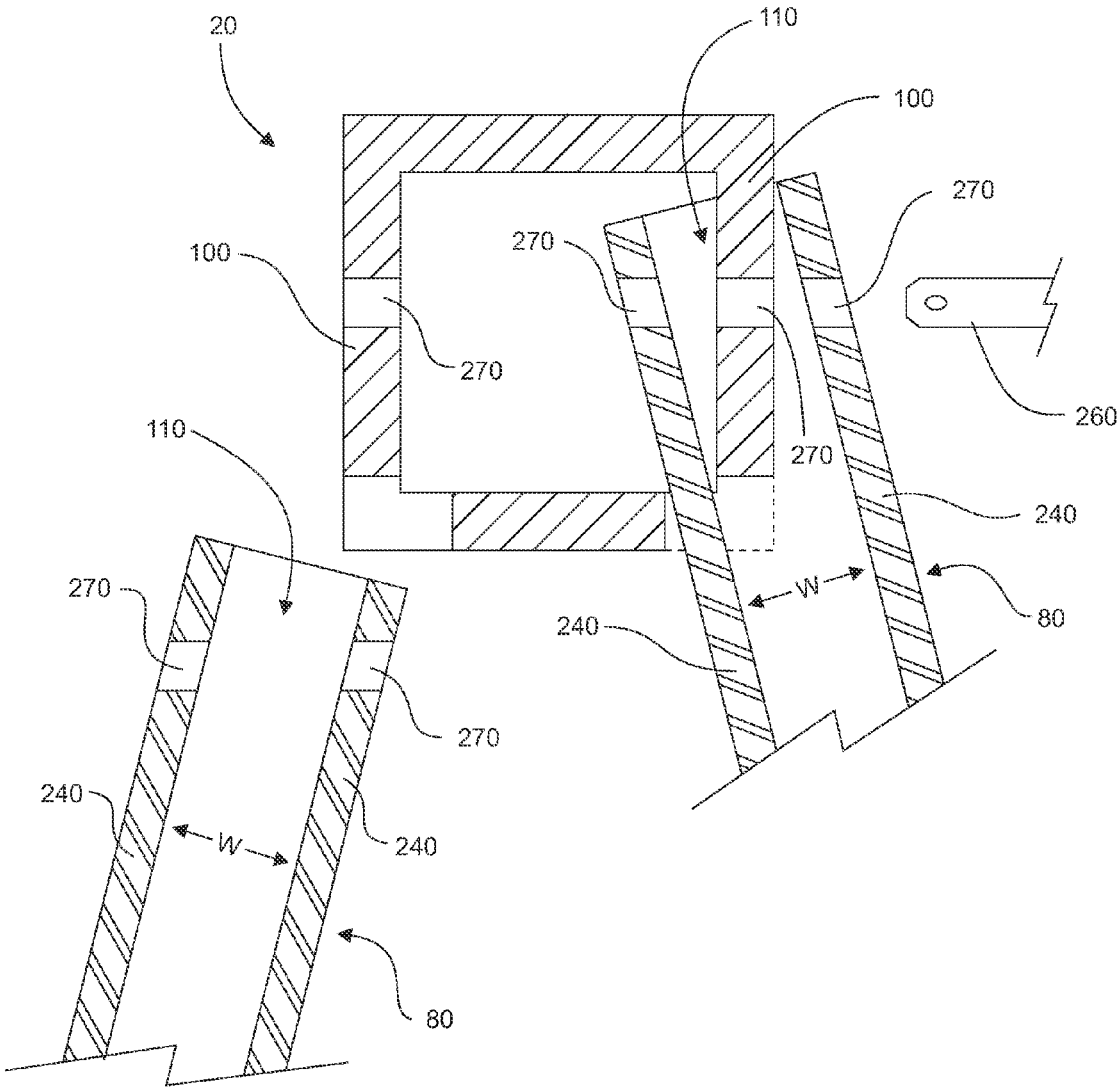
FIG. 4 is a cross-sectional view of a horizontal beam through the connector tab and illustrating cross-sections of a pair of tubular legs, one engaged with a tab and the other poised for engagement with an opposing tab.

As shown in FIG. 4, the recess 110 of each leg 80 has a lateral width W or spacing between lateral peripheral walls 240,240 sufficient to permit angular adjustment of each of the legs 80 when removably connected to its corresponding tab 100, enabling adjustment of a lateral spacing therebetween. Each leg 80 can be removably secured to its corresponding tab 100 by any known locking means. As shown, and in an embodiment, a bolt or pin 260 can be used to removably secure a leg 80 to its corresponding tab 100 to avoid loss of the leg 80 if moving the support beam 20. The pin 260 can pass through ports 270 formed in each of the leg's lateral peripheral walls 240,240 and the tab 100. The respective diameter of the port 270 and pin 260 can be oversized to avoid accepting much or any of the load from the support beam 20. One long pin can be used pass through both the upper ends 120,120 of each leg of the pair of legs 30,50 and respective tabs 100,100. As shown in FIG. 1, a spring clip 280 or other retainer can be used to retain the pin 270 in position.

Figures 5A, 5B, 5C:
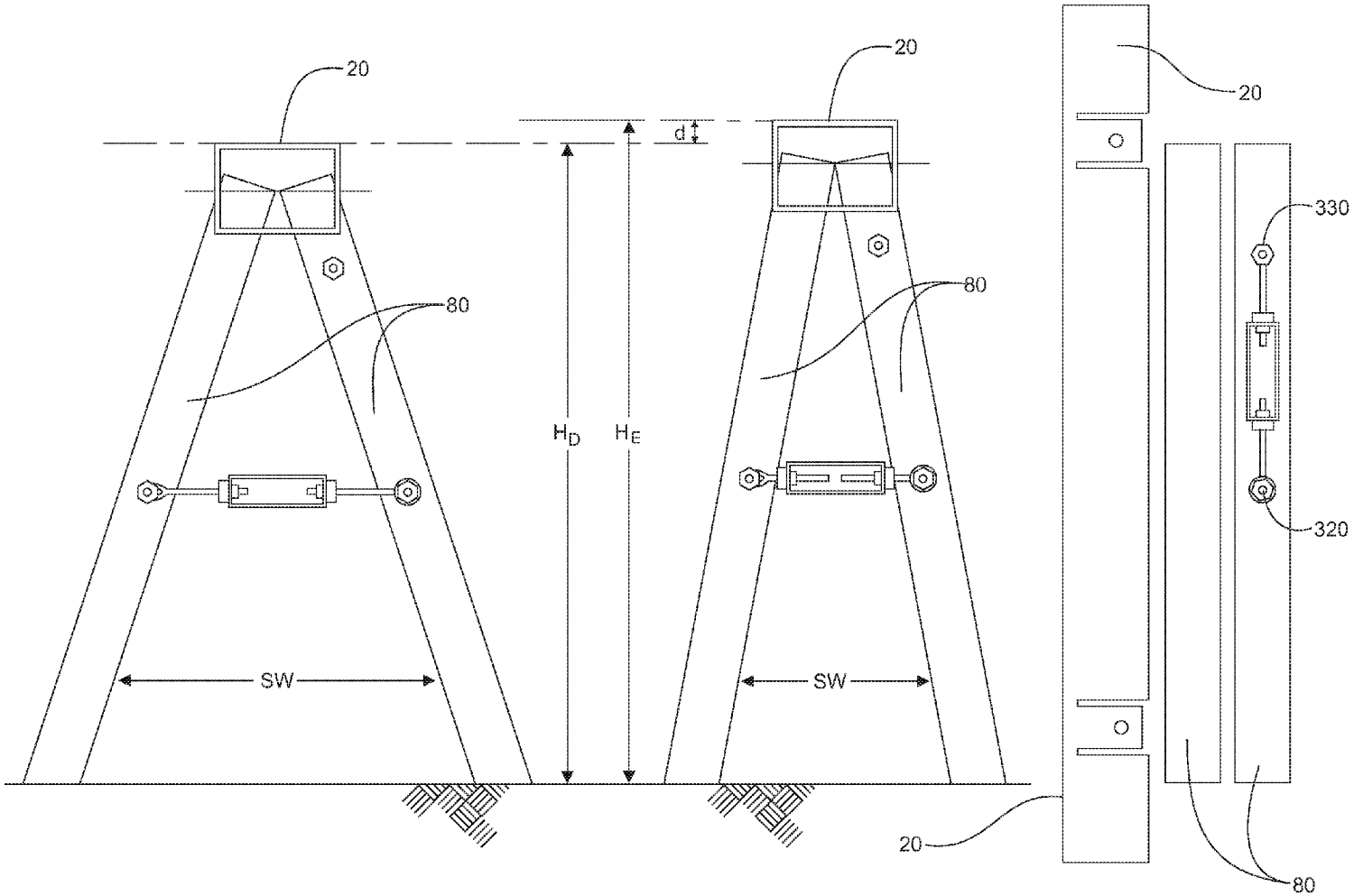
FIGS. 5A and 5B are end views of the sawhorse of FIG. 1A illustrating the use of a turnbuckle for adjusting the height of one end of the sawhorse, from a lowered position to a raised position respectively.
FIG. 5C is view of the horizontal beam and two of the legs of a disassembled sawhorse of FIG. 1A.

Referring back to FIG. 1, and to FIGS. 5A and 5B the two legs 80,80 of each of first and second pairs of legs 30,50 are interconnected for maintaining their relative orientation and providing stability. In an embodiment, the pair of legs 30 or 50 are interconnected to one another by an adjuster 290, such as a turnbuckle, for manipulating a lateral spacing S between the legs of each pair of legs 30 or 50. Through adjustment of the lateral spacing S between the two legs 80,80 of a pair of legs 30 or 50, the height H of the support beam 20 is adjusted above that pair of legs. Adjustment of the lateral spacing of both pairs of legs can level or introduce a particular offset or angle along the beam 20.

As shown in FIG. 5A, one of the pair of legs 30 or 50 is shown having been adjusted to a wide lateral spacing $S_w$ for establishing a depressed height $H_D$ of that first or second end 40,60 of support beam 20. As shown in FIG. 5B, the pair of legs of FIG. 5A is shown having been adjusted to a narrow lateral spacing $S_N$ for establishing an elevated height $H_E$ of the support beam 20. Accordingly, by adjusting the lateral spacing S between the first pair of legs 30 or further adjusting the lateral spacing between the second pair of legs 50, the support beam 20 can be leveled or placed at a particular angle to accommodate a workpiece supported thereon.

Figure 6A:
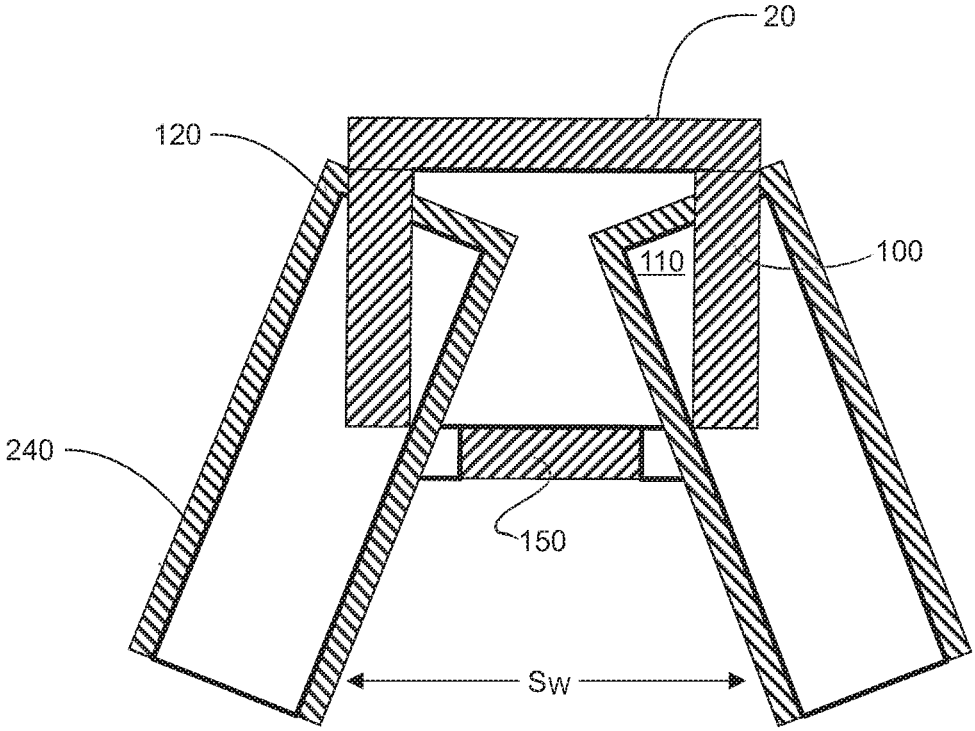
FIGS. 6A and 6B are cross-sectional views of the connectors of one end of the horizontal beam of FIGS. 5A and 5B respectively through the connector tab and illustrating the variation of the connection during height adjustment.
Figure 6B:
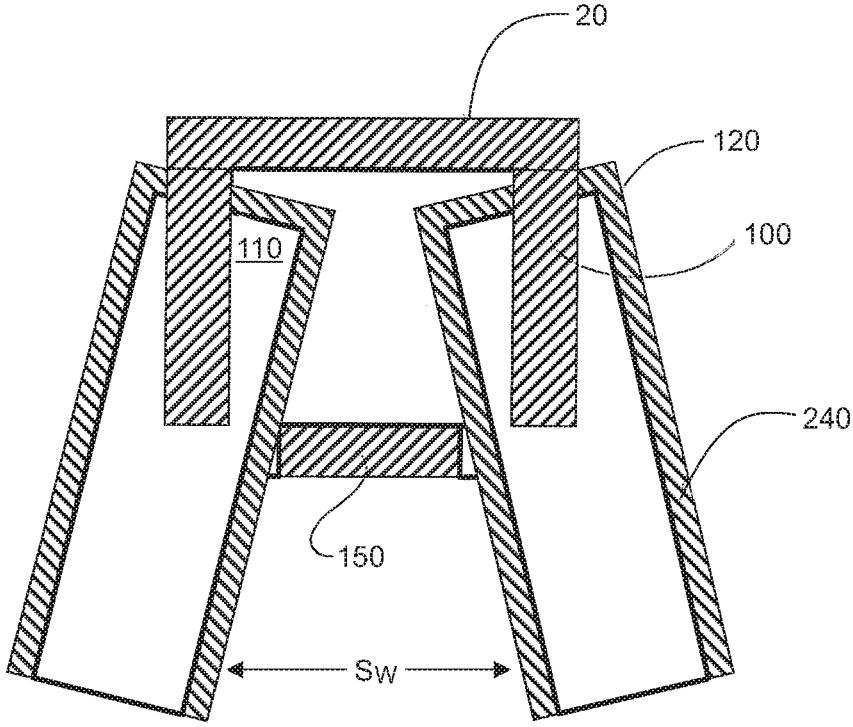

As shown in FIGS. 6A and 6B spacing between the lateral peripheral walls 240,240 of the upper end 120 of the legs 80 and the spacing between the free end 130 of the tab 100 and the bottom wall 150 assist in limiting angular rotation of the legs 80 relative to the beam 20 and lateral spacing S of a pair of legs 30 or 50. As shown in FIG. 6A, for a wide lateral spacing $S_W$ of two legs of the pair of legs such as that shown in FIG. 5A, the upper end 120 can rotate into the support beam 20. As shown in FIG. 6B, for a narrow lateral spacing $S_N$ of two legs of the pair of legs such as that shown in FIG. 5B, the upper end 120 can rotate away from the support beam 20, pivoting about a brace portion 150F of bottom wall 150.

With reference to FIG. 5C, for knocking down of the sawhorse 10, the locking means or pins 260 for the first and second pairs of the legs 30,50 can be removed, and the leg recesses 110 withdrawn from their respective tabs 100. The two pairs of legs 30,50, being four independent legs 80,80, 80,80, and the support beam 20 can be laid side-by-side as a compact kit for storage or shipment. The adjuster 290, or turnbuckle in this embodiment, is normally connected between respective first and second mount or anchor points 310,320 on each leg of a pair of legs 30,50. With reference to FIGS. 1A, 1B and 5C, for storage, one distal end 300 of the turnbuckle can be disconnected from a first anchor point 310 on one leg of a pair of legs, pivoted about the second anchor point 320 on the other leg of the pair of legs and temporarily reconnected at a third anchor point 330 wholly on the same leg as the second anchor point 320. In an embodiment, the first, second and third anchor points 310,320,330 are retaining pins, bolts or the like.

In one example, a heavy duty, knock-down sawhorse can be manufactured using commercially available steel rectilinear hollow tubing. In an embodiment, a 5 foot long section of 2 inch by 2 inch square tubing, having a wall thickness of about ¼ inches, can be used as the support beam. On the first side wall (such as the right side wall), at about 6 inches from one of a first or second end of the support beam, a first slot of about 1¾ inches in length can be cut from about the extent of the hollow interior at the top wall to about or through the bottom wall. A second slot of about 1¾ inches in length is cut, spaced longitudinally from the first slot and parallel thereto. The bottom wall between the first and second slots is removed by at least the thickness of the bottom wall to expose the end 130 of the tab 110.

Each leg can be a 31 inch long section of 2 inch by 1 inch square tubing, having a wall thickness of about ⅛ inches. Accordingly, the first and second slots have a kerf width of about ⅛ or slightly wider for tolerance considerations, corresponding to the wall thickness of the end peripheral walls of a leg. The first and second slots are longitudinally spaced, from their longitudinal extents, about 2" corresponding to the longitudinal spacing of end peripheral walls 220,220 of the leg.

The first and second slots 180,190 can be interconnected by removal of a longitudinal portion of the bottom wall to form a tab about 1¾ inches wide and downwardly depending from the top wall. The interconnection of the first and second slots to free the tab end 130 can be by recessing a portion of an edge of the bottom wall, the portion of the edge being defined by the bottom wall and the first side wall and being between the first and second slots. The bottom wall is recessed by about the tab thickness, being the wall thickness, and a further amount corresponding about to the wall thickness of the upper end of the leg. Accordingly, when connected, the legs can be rotated angularly and substantially vertically. Three more tabs can be cut from the first and second lateral side walls in similar fashion for forming a total of at least four tabs, a pair of tabs at each of the first and second ends of the support beam.

Applicant notes that the tolerances for all of the cuts in the formation of the tabs are about 1/500 inches. Such tolerances provides for a snug or tight fitment of the legs over the tabs and which limits longitudinal movement of the sawhorse.

Each of the four sections of rectangular tubing can be fit about each of the four tabs of the horizontal beam such that the upper end recess 110 of each leg engages a top of the slot or kerf or engages the top wall 140. Each pair of legs 30,50 is secured to the support beam 20 by a pin.

For each pair of legs, a concentric port is drilled through each leg as well as through their corresponding tabs. A single pin sufficiently long enough to pass through both supporting legs and the width of the horizontal beam is then inserted through the concentric port. The pin can be secured in position by a simple retaining clip.

Finally, a turnbuckle is attached to interconnect the legs of each pair of legs, for adjusting a lateral spacing between the two legs. The turnbuckle can be attached at about 20 inches from the upper end of the legs.

Applicant has found that this particular embodiment enables the working height be adjustable vertically by about one inch at each end 40,60. This enables the sawhorse to have a maximum slope of about 2 inches. Accordingly, this particular embodiment can be adjusted to provide a level work surface on ground surfaces that have a slope of no greater than about 2 inches.

The embodiments of the invention for which an exclusive property or privilege is claimed are defined as follows:

1. A knock-down sawhorse comprising:

a beam having a longitudinal extent, the beam being a hollow, structural tubing having a top wall, a bottom wall and lateral sides;

at least four legs, a first pair of the legs supporting a first end of the beam above the ground and a second pair of the legs supporting a second end of the beam above the ground, each leg having an upper end, the upper end having an axially-extending recess formed therein bounded by end peripheral walls; and at least four connectors arranged along the beam, at least first pair of the connectors arranged on opposing lateral sides of the beam, and a second pair of the connectors arranged on opposing lateral sides of the beam spaced longitudinally from the first pair of connectors, wherein each connector further comprises a pair of longitudinally spaced slots formed transversely along the lateral sides and generally downwardly from the top wall and longitudinally through the bottom wall for forming a tab therebetween; and wherein each tab engages the axially-extending recess of a corresponding leg for supporting the beam above each leg, each pair of legs splayed apart laterally at an angle from the beam for forming the sawhorse.

2. The knock-down sawhorse of claim 1, wherein each leg is a hollow, rectangular structural tubing having peripheral walls, the axially-extending recess being formed between peripheral walls.

3. The knock-down sawhorse of claim 1, wherein each leg further comprises an anchor point intermediate along the leg, a first anchor point on one leg and a second anchor point on the other leg, and wherein a first adjuster extends between first and second anchor points of the first pair of legs and a second adjuster extends between the first and second anchor points of the second pair of legs, wherein the first adjuster adjusts the lateral spacing between the splayed legs of the first pair of legs and adjusting the working height the beam thereabove, and wherein the second adjuster adjusts the lateral spacing between the splayed legs of the second pair of legs and adjusting the working height the beam thereabove.

4. The knock-down sawhorse of claim 3, wherein each adjuster is a turnbuckle.

5. The knock-down sawhorse of claim 4, wherein at least one leg of each of the first and second pair of legs further comprises a third anchor point for storage of the turnbuckle wholly on one leg.

* * * * *